US011566476B2

(12) United States Patent
Egbe

(10) Patent No.: US 11,566,476 B2
(45) Date of Patent: Jan. 31, 2023

(54) RELEASING TUBULARS IN WELLBORES USING DOWNHOLE RELEASE TOOLS

(71) Applicant: Saudi Arabian Oil Company, Dhahran (SA)

(72) Inventor: Peter Ido Egbe, Abqaiq (SA)

(73) Assignee: Saudi Arabian Oil Company, Dhahran (SA)

( * ) Notice: Subject to any disclaimer, the term of this patent is extended or adjusted under 35 U.S.C. 154(b) by 130 days.

(21) Appl. No.: 17/112,226

(22) Filed: Dec. 4, 2020

(65) Prior Publication Data

US 2022/0178217 A1 Jun. 9, 2022

(51) Int. Cl.
*E21B 17/06* (2006.01)
*E21B 47/007* (2012.01)

(52) U.S. Cl.
CPC ..... *E21B 17/06* (2013.01); *E21B 47/007* (2020.05)

(58) Field of Classification Search
CPC ..... E21B 17/06; E21B 47/007
See application file for complete search history.

(56) References Cited

U.S. PATENT DOCUMENTS 2,462,477 A * 2/1949 Edwards ..... E21B 17/06 166/242.6
2,535,435 A 12/1950 Massey
3,690,163 A 9/1972 Shannon et al.
4,440,019 A 4/1984 Marshall
7,389,183 B2 6/2008 Gray
9,879,523 B2 1/2018 Brown-Kerr et al.
10,669,810 B2 6/2020 Egbe et al.
2009/0283322 A1 11/2009 Dove
2015/0034311 A1* 2/2015 Tunget ..... E21B 47/12 166/250.14

(Continued)

FOREIGN PATENT DOCUMENTS

GB 2568224 5/2019
WO WO 2014184587 11/2014
WO 2015199986 12/2015

OTHER PUBLICATIONS

PCT International Invitation to Pay Additional Fees and Where Applicable Protest Fees in International Appln. No. PCT/US2021/061799, dated Mar. 4, 2022, 16 pages.

(Continued)

*Primary Examiner* — D. Andrews
(74) *Attorney, Agent, or Firm* — Fish & Richardson P.C.

(57) ABSTRACT

A downhole release tools, systems, and methods are described. The tool configured to release a string in a wellbore includes: a cylindrical body with an uphole end defining a first set of internal threads and a downhole end defining a second set of internal threads; a sensor operable to measure strain in the cylindrical body, a magnetic field, or both; a release joint with an uphole end defining a first set of external threads and a frustoconical downhole end defining a second set of external threads, the release joint attached to the cylindrical body by engagement between the first set of external threads of the release joint and the second set of internal threads of the cylindrical body; safety pins rotationally fixing the release joint in position relative to the cylindrical body; and a drive system operable to rotate the release joint relative to the cylindrical body.

15 Claims, 6 Drawing Sheets

(56) References Cited

U.S. PATENT DOCUMENTS

| | | | | |
|---|---|---|---|---|
| 2015/0369038 | A1* | 12/2015 | Brown-Kerr | E21B 47/18 166/242.6 |
| 2019/0040738 | A1 | 2/2019 | Ramjit et al. | |
| 2019/0257154 | A1 | 8/2019 | Copold et al. | |

OTHER PUBLICATIONS

PCT International Search Report and Written Opinion in International Appln. No. PCT/US2021/061799, dated May 11, 2022, 20 pages.

* cited by examiner

RELEASING TUBULARS IN WELLBORES USING DOWNHOLE RELEASE TOOLS

TECHNICAL FIELD

The present disclosure generally relates to drilling tools and operations for use in a wellbore, more particularly release system, tools and methods that can be used to release a stuck drill string 106 in a wellbore.

BACKGROUND

Drill pipes may be employed to drill oil and gas wellbores. Collectively, when connected, they form one entity called the drill string. In some instances, the drill string 106 may get "stuck" in the wellbore due to the shape of the hole, accumulation of cuttings, or differential pressure. In such an event, the drilling crew is unable to move the drill string down to continue drilling or pull the string out-of-hole.

Mechanical and hydraulic tools can be used to free the drill string 106 from the wellbore. Using chemicals (e.g., acids), or simply cutting of the drill string 106, pulling the freed part out of the hole, and continuing drilling "sidetrack" within the wellbore are ways to resolve the issue. Mechanical and hydraulic tools can be run downhole on a wire-line and typically rely on prior knowledge of the location of the "stuck" drill string 106.

SUMMARY

This specification describes systems, tools, and methods to locate a stuck point and release a stuck tubular in a wellbore. The systems include multiple release incorporated in a downhole tubular (e.g., a drill string, a casing, or a completion tubular) deployed in a well bore. These tools are incorporated in the tubular rather than being otherwise supported from the surface (e.g., by a wireline). These systems do not require prior knowledge of the "stuck" pipe location. Although described with reference to a drill string 106, these systems, tools, and methods can be implemented in other downhole tubulars, for example, or a completion tubular.

The systems, tools, and methods described in this specification provide an approach in multiple release tools are interspaced along a drill string 106 or other downhole tubular at pre-determined intervals. The release tools include a body, a sensor module, a release joint, and a drive system. The body includes threads positioned at its uphole end and threads positioned at its downhole end. The terms "uphole end" and "downhole end" are used to indicate the end of a component that would be uphole or downhole when a component is deployed in a wellbore rather indicating an absolute direction.

The release joint is attached to the body by the threaded connections. The tool is deployed with the release joint locked into position relative to the body. Some tools include safety pins that prevent rotation of the release joint relative to the body. Some systems include other locking mechanisms (e.g., a latch system). The drive system is operable to rotate the release joint relative to the cylindrical body. In tools that include safety pins as a locking mechanism, the force applied by the drive system is sufficient to break the safety and rotate the release joint relative to the body. In tools with other locking mechanisms, the locking mechanism can be released before the drive system is activated.

The sensor module can be placed on the body of the release tool and measures parameter (e.g., strain or a magnetic field) indicative of whether the specific release tool is uphole or downhole of the stuck point. The sensor module can include sensors, instrumentation and signal processing circuits, receivers, transmitters, connecting probes, and data storing and processing devices. The sensor can function as a downhole control unit for the tool or the tool can incorporate a separate control unit. Incorporation of a downhole control unit enables the tool to function autonomously.

In a stuck pipe situation, each downhole autonomous release tool is activated, for example, by pumping radio frequency identification (RFID) tags downhole or by serial communication along the line of the tools. The system identifies the stuck point above which the string is free to move and engages the release joint of the adjacent release tool uphole of the stuck point to sever the string at a depth above the stuck point without being independently supported from the surface (e.g., on a wire-line). The release joints can be mechanically or hydraulically actuated.

In some aspects, a downhole release tool configured to release a string in a wellbore includes: a cylindrical body with an uphole end defining a first set of internal threads and a downhole end defining a second set of internal threads; a sensor module disposed on an outer surface of the cylindrical body, the sensor operable to measure strain in the cylindrical body, a magnetic field, or both; a release joint with an uphole end defining a first set of external threads and a frustoconical downhole end defining a second set of external threads, the release joint attached to the cylindrical body by engagement between the first set of external threads of the release joint and the second set of internal threads of the cylindrical body; safety pins rotationally fixing the release joint in position relative to the cylindrical body; and a drive system operable to rotate the release joint relative to the cylindrical body.

Embodiments of the downhole release tool configured to release a string in a wellbore can include one or more of the following features.

In some embodiments, the sensor module includes one or more radio frequency identification (RFID) readers. In some cases, the sensor module includes a piezo-electric crystal sensor. In some cases, the sensor module includes an acoustic sensor. In some cases, the sensor module includes a feedback mechanism. In some cases, the sensor module is positioned in a recess on an outer surface of the body.

In some embodiments, the cylindrical body has an internal diameter equal to an internal diameter of a pipe in the string.

In some embodiments, the hollow drive system includes a turbine. In some cases, the tool also includes a fluid by-pass system configured to power the drive system.

In some embodiments, the hollow drive system includes an autonomous mechanical energy source.

In some embodiments, the tool includes a locking mechanism. In some cases, the locking mechanism includes a latch system.

In some aspects, a system for releasing a drill string in a wellbore includes: a plurality of downhole autonomous release tools, wherein each of the plurality of downhole autonomous release tools includes: a cylindrical body; a sensor module disposed on an outer surface of the cylindrical body, the sensor operable to measure strain in the cylindrical body, a magnetic field, or both; a release joint attached to the cylindrical body by a threaded connection; safety pins rotationally fixing the release joint in position relative to the cylindrical body; a drive system operable to rotate the release joint relative to the cylindrical body; and a plurality of radio frequency identification (RFID) tags in communication with the sensor module and configured to be pump downhole.

Embodiments of the system for releasing a drill string in a wellbore can include one or more of the following features.

In some embodiments, the system includes a first downhole autonomous release tool spaced between 100 and 200 feet from a second, adjacent downhole autonomous release tool.

In some embodiments, the system includes a first downhole autonomous release tool spaced between 200 and 500 feet from a second, adjacent downhole autonomous release tool.

In some aspects, a method for releasing a drill string in a wellbore includes: applying an over-pull force to a stuck drill string to keep the string in tension; sensing the stuck drill string along its axis with a sensor system embedded into a downhole autonomous release tool; receiving and processing data from the sensor system; identifying a stuck location of the drill string and correlating the stuck location to a depth of the identified location; and sending a signal to a drive system of the downhole autonomous release tool to engage and sever the drill string above the stuck point.

The downhole autonomous release tools can help to locate the "free" point (i.e., the first release tool uphole of the stuck point) and recover the drill string 106 above the "free" point without the need to deploy additional tools and equipment. The release tool operates without being independently supported from the surface (e.g., on a wire-line). The downhole autonomous release tool has an internal diameter equal in size to the pipes of the drill string 106 that allows deployment of additional tools downhole through the drill string 106 during the course of a drilling operation. This approach simplifies the process of identifying the free point of a stuck drill string 106, severing the drill string 106, and extracting the free part of the drill string 106 out of the hole. It also reduces lost operation time and total cost. The downhole autonomous release tool saves tripping time and eliminates the need for prior knowledge of the "stuck pipe" location. This approach also reduces potential scrap and junk in-hole due to failed remedial equipment.

The downhole autonomous release tool design provides economic advantages by eliminating cost and time needed to mobilize, rig-up, and operate a wire-line unit. These factors can result in improved and efficient drilling operations at reduced operating time. The downhole autonomous release tool can also be used in casing and other completion tubulars.

The details of one or more embodiments of these systems and methods are set forth in the accompanying drawings and the description below. Other features, objects, and advantages of these systems and methods will be apparent from the description and drawings, and from the claims.

DETAILED DESCRIPTION

This specification describes systems, tools, and methods to locate a stuck point and release a stuck tubular in a wellbore. The systems include multiple release incorporated in a downhole tubular (e.g., a drill string 106, a casing, or a completion tubular) deployed in a well bore. These tools are incorporated in the tubular rather than being otherwise supported from the surface (e.g., by a wireline). These systems do not require prior knowledge of the "stuck" pipe location. Although described with reference to a drill string 106, these systems, tools, and methods can be implemented in other downhole tubulars, for example, or a completion tubular.

The systems, tools, and methods described in this specification provide an approach in multiple release tools are interspaced along a drill string 106 or other downhole tubular at pre-determined intervals. The release tools include a body, a sensor module, a release joint, and a drive system. The body includes threads positioned at its uphole end and threads positioned at its downhole end.

The release joint is attached to the body by the threaded connections. The tool is deployed with the release joint locked into position relative to the body. Some tools include safety pins that prevent rotation of the release joint relative to the body. Some systems include other locking mechanisms (e.g., a latch system). The drive system is operable to rotate the release joint relative to the cylindrical body. In tools that include safety pins as a locking mechanism, the force applied by the drive system is sufficient to break the safety and rotate the release joint relative to the body. In tools with other locking mechanisms, the locking mechanism can be released before the drive system is activated.

The sensor module can be placed on the body of the release tool and measures parameter (e.g., strain or a magnetic field) indicative of whether the specific release tool is uphole or downhole of the stuck point. The sensor module can include sensors, instrumentation and signal processing circuits, receivers, transmitters, connecting probes, and data storing and processing devices. The sensor can function as a downhole control unit for the tool or the tool can incorporate a separate control unit. Incorporation of a downhole control unit enables the tool to function autonomously.

In a stuck pipe situation, each downhole autonomous release tool is activated, for example, by pumping radio frequency identification (RFID) tags downhole or by serial communication along the line of the tools. The system identifies the stuck point above which the string is free to move and engages the release joint of the adjacent release tool uphole of the stuck point to sever the string at a depth above the stuck point without being independently supported from the surface (e.g., on a wire-line). The release joints can be mechanically or hydraulically actuated.

Figure 1A:
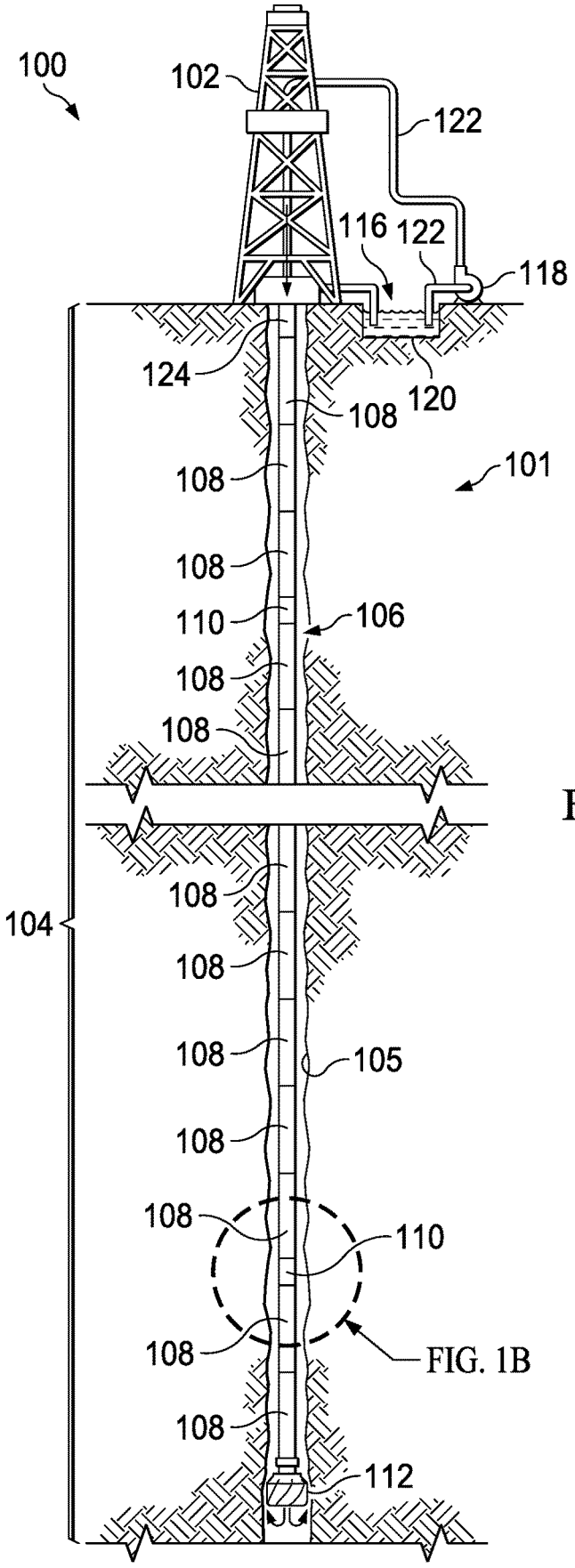
FIG. 1A is a schematic view of a drilling system including a drill string 106 with multiple downhole release tools.
Figure 1B:
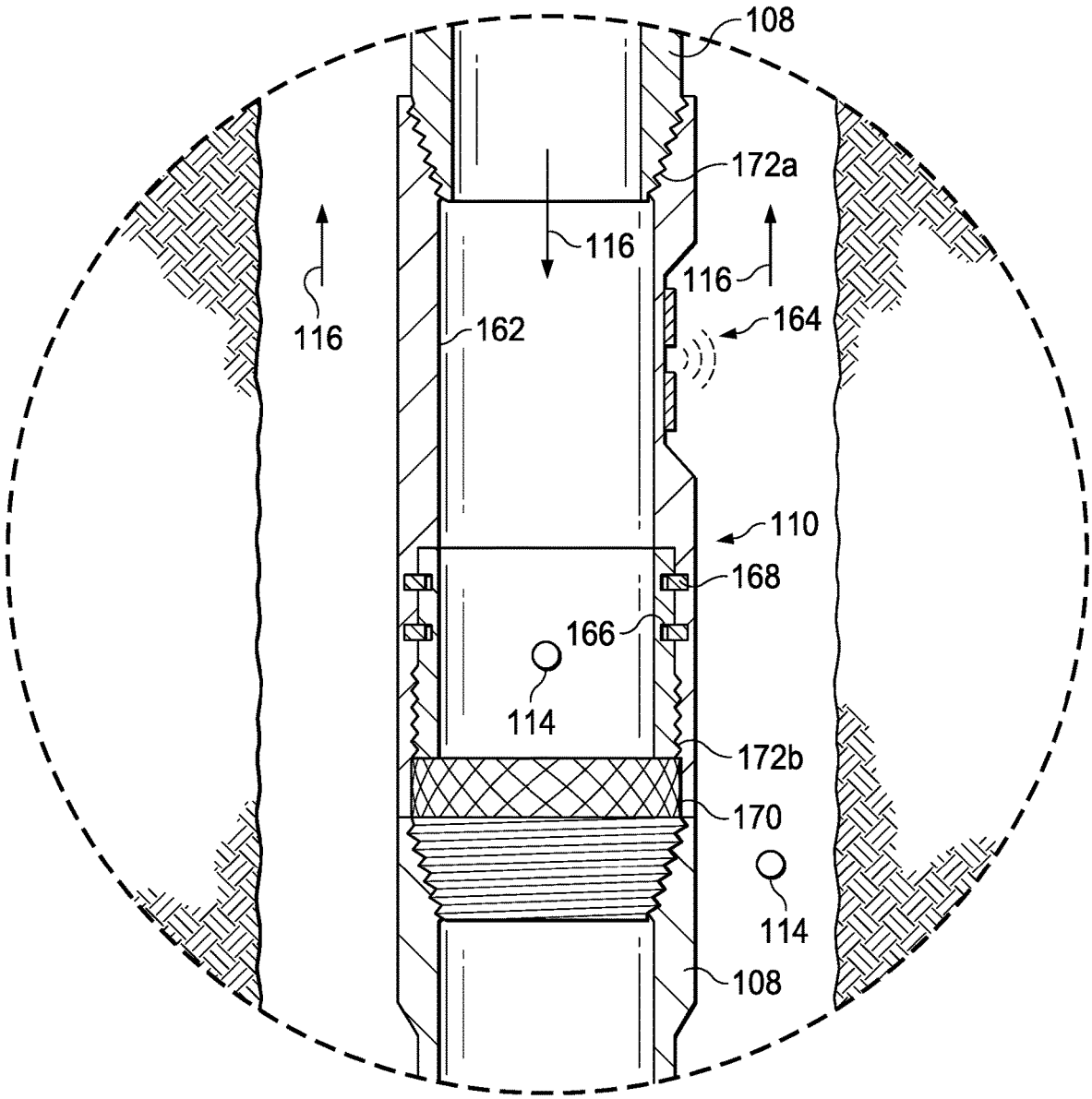
FIG. 1B is a schematic cross-sectional view of a portion of the drill string 106 of FIG. 1A.

FIG. 1A is a schematic view of a downhole tubular release system incorporating multiple release tools. FIG. 1B is a schematic cross-sectional view of a release tool and adjacent tubulars. In the example illustrated by FIGS. 1A and 1B, the downhole release system 100 is described with reference to a drilling system 101 but can be implemented in other downhole tubulars, for example, or a completion tubular.

The drilling system 101 includes a derrick 102 that supports a downhole portion 104 of the drilling system 101. The drilling system 101 is being used to form a wellbore 105.

The downhole portion 104 of the drilling system 101 includes a drill string 106 with multiple drill pipes 108, multiple release tools 110 connecting sections of the drill string 106 formed by multiple drill pipes 108, and a bottom hole assembly with a drill bit 112 attached at the downhole end of the drill string 106. The spacing between release tools 110 is typically between 500 and 1000 feet (ft) where there is potential risk of a stuck drill string 106. The illustrated wellbore is a vertical wellbore but the release systems, tools, and methods can also be used, for example, in a deviated wellbore or a horizontal wellbore.

The spacing between release tools 110 can be chosen based on the likelihood of a particular drilling operation encountering a stuck pipe situation with relevant factors including, for example, the formation being drilled into, whether the wellbore being formed is straight or deviated, high differential pressure between the wellbore and formation pore pressure, potential for wellbore instability and collapse across certain intervals, and expectations of inefficient hole cleaning. For example, when drilling horizontally in an environment with a high differential pressure, the drill string 106 might include 200 to 500 ft between adjacent release tools 110. In another example, when drilling in a zone with high potential for wellbore collapse, the drill string 106 might include 100 to 200 ft between adjacent release tools 110.

During drilling operations, a drilling fluid 116 (sometimes referred to as drilling mud) is pumped downhole through the drill string 106 to rotate the drill bit 112. A circulation pump 118 draws the drilling fluid 116 from a mud pit 120 and pumps the drilling fluid 116 into the drill string 106. Conduits 122 provide hydraulic connections between the circulation pump 118 and the drill string 106, between the downhole portion 104 and the mud pit 120, and between the mud pit 120 and the circulation pump 118. The conduits can include hose, pipe, open channels, filters, or combinations of these components capable of handling the desired pressures and flowrates.

The drilling fluid can be used to communicate and control the release tools 110. For example, the illustrated release tools 100 include sensor modules 164 operable to communicate with RFID tags 114. The circulating drilling fluid 116 (arrows indicating flow direction) can be used to carry RFID tags downhole past the release tools. In systems that include a pressure signal generator (PSG) sub 124, the drilling fluid can be used as medium through which pressure pulses generated by the PSG sub travel downhole.

FIG. 1B shows one of the release tools 110 positioned between two drill pipes 108. The release tool 110 is an independent unit that includes a body 162, a sensor module 164, a release joint 166, a plurality of safety pins 168, and a drive system 170. The body 162 has a cylindrical configuration with an uphole end defining a first set of internal threads 172*a* and downhole end defining a second set of internal threads 172*b*.

The cylindrical body 162 includes an internal diameter equal in size as the diameter of the drill pipe 108 in use. The design with equal internal diameter is beneficial for the deployment of other tools during the course of a typical drilling operation. The body 162 and the sensor module 164 are attached to each other. The sensor module 164 is positioned on an outer surface of the cylindrical body 162 inside a recess or a groove. In some tools, the sensor module 164 is incorporated inside the cylindrical body 162 of the tool 110.

Figure 2A:
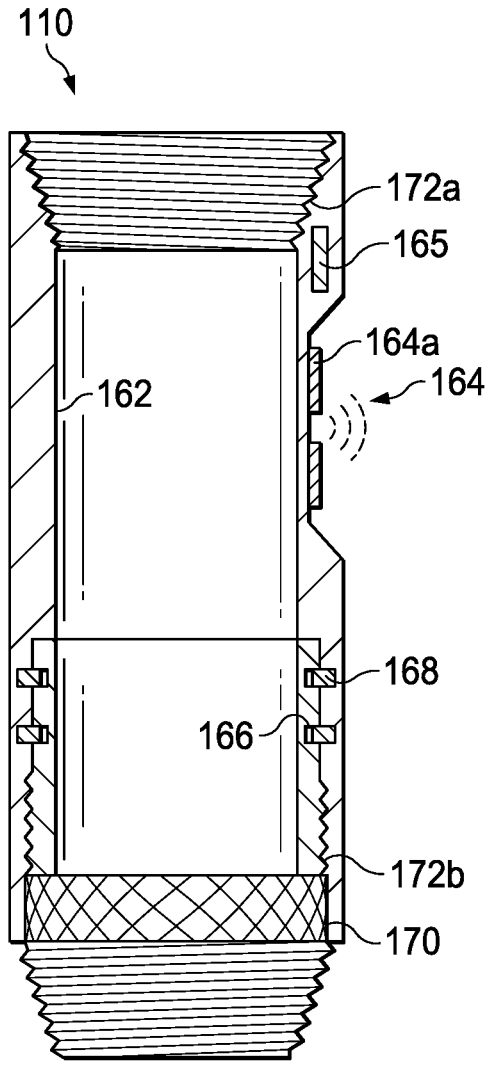
FIGS. 2A and 2B are schematic cross-sectional views of a downhole release tool with its body and release joint assembled and separated, respectiely.
Figure 2B:
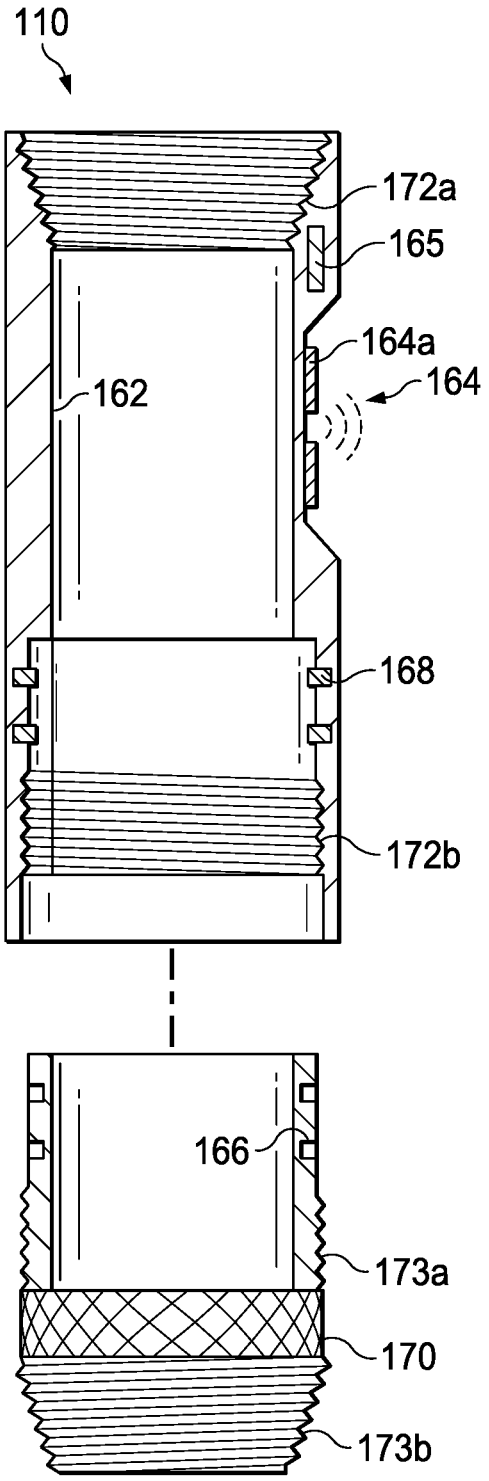

FIGS. 2A and 2B are schematic cross-sectional views of a downhole release tool with its body and release joint assembled and separated, respectively. The release joint 166 includes a first set of external threads 173*a* at its uphole end and a second set of external threads 173*b* at its frustoconical downhole end. When the tool 110 is assembled, the release joint 166 is attached to the cylindrical body 162 by engagement between the first set of external threads 173*a* of the release joint 166 and the second set of internal threads of the cylindrical body 162. The safety pins 168 fix the release joint 166 in position relative to the cylindrical body 162 and prevent rotation of the release joint 166 relative to the body 162. Some systems include other locking mechanisms (e.g., a latch system). As discussed in more detail below, the drive system 170 is operable to rotate the release joint 166 relative to the cylindrical body. In tools that include safety pins as a locking mechanism, the force applied by the drive system is sufficient to break the safety and rotate the release joint 166 relative to the body. In tools with other locking mechanisms, the locking mechanism can be released before the drive system is activated.

The sensor module 164 measures parameters (e.g., strain or a magnetic field) indicative of whether a specific release tool is uphole or downhole of the stuck point. The sensor module 164 can include sensors, instrumentation and signal processing circuits, receivers, transmitters, connecting probes, and data storing and processing devices. The sensor module 164 functions as a downhole control unit for the release tool 110 and is electronic communication with the drive system 170. The sensor module 164 also incorporates a transceiver 164*a* that is operable to send and receive signals from other release tools. Some release tools incorporate a separate control unit 165 with a processor that is in electronic communication with the sensor module 164 and the drive system 170. Incorporation of a downhole control unit enables the tool to function autonomously.

The sensor module 164 includes RFID readers or tags. The RFID readers are triggered by electromagnetic interrogation pulse from a nearby RFID device. The RFID readers include piezo-electric crystal sensors that automatically measure strain in the cylindrical body, a magnetic field, or both. When the drill string 106 is stuck, an over-pull force is applied to the drill string 106 at the surface. The over-pull force places portions of the drill string 106 uphole of the stuck point in tension while portions of the drill string 106 downhole of the stuck point remain in a rest state. In particular, the portion of the drill string 106 above the stuck point 142 (i.e., the free portion of the drill string 106) extends under the applied surface over-pull force in line with the fundamentals of Young's Modulus of elasticity. In its rest state, the drill string 106 will generate a magnetic field. By comparing strain and magnetic field measurements before and after application, each release tool can be identified as being above or below the stuck point. In some implementations, the system can have other indicators of stuck pipe location. For example, the system can assess sonic or sound waves propagating through a free body and a constrained body using a feedback mechanism to identify a stuck location.

The drive system 170 is operable to rotate the release joint 166 relative to the body 162 of the release tool to initiate severance of the drill string 106. The drive system 170 is powered by a drilling fluid flow (e.g., >1% flow diversion) or by an autonomous mechanical energy source (e.g., a lithium battery). The drive system 170 of the tool 110 includes a fluid by-pass system that allows diversion of drilling fluid flow to power the drive system 170. When the drive system 170 is activated, the safety pins 168 are sheared, and the release joints 166 rotate about their own independent axis, and away from the threaded connection with the body 162. The drill string 106 is fixed in tension while the release joints 166 unscrew in the opposite direction (i.e., counter clockwise). The safety pins 168 help increase the allowable torque that the release joints 166 can sustain before failure. The properties of both the safety pins 168 and the release joints 166 include 20% larger rated torque that of the drill pipe 108.

Figure 3A:
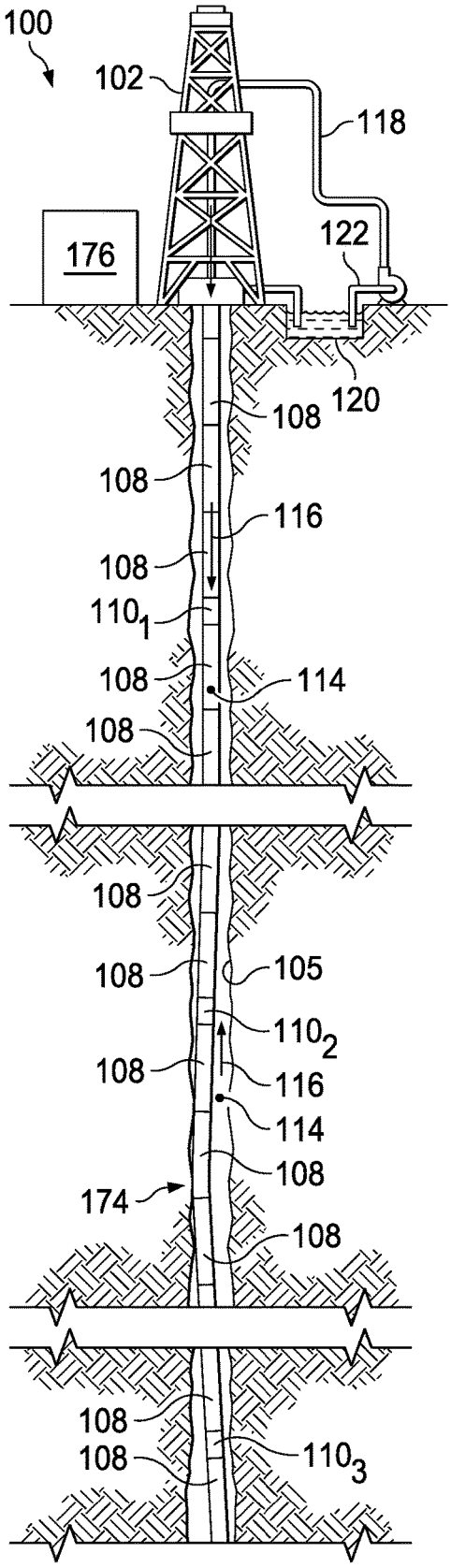
FIGS. 3A and 3B are schematic views of a stuck drill string 106 scenario before (FIG. 3A) and after (FIG. 3B) operation of a release tool.
Figure 3B:
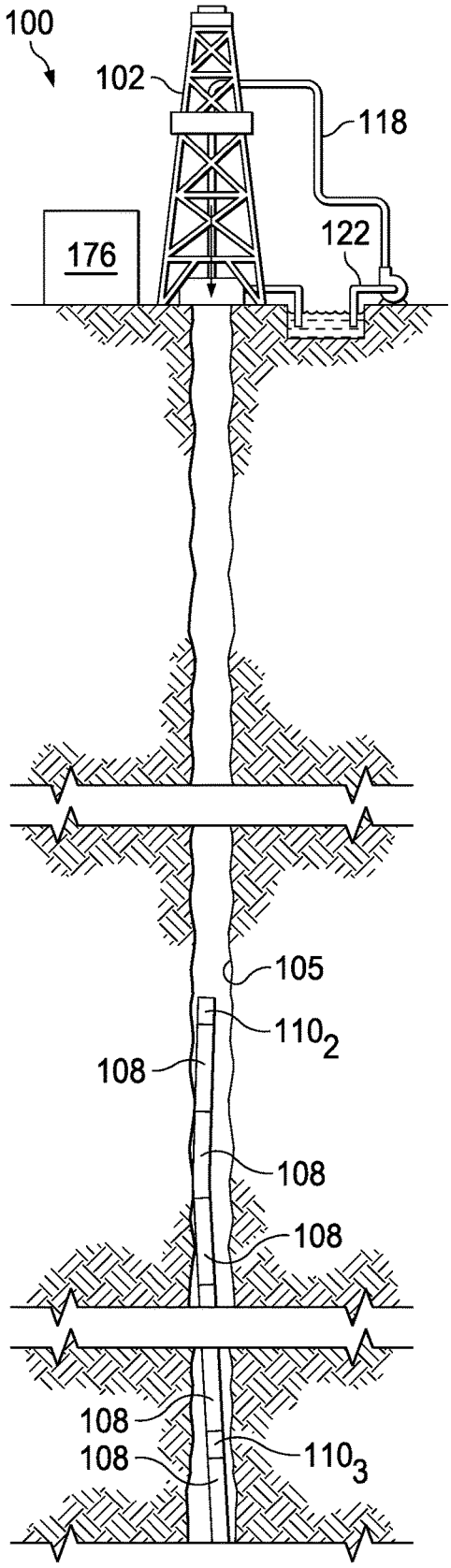
Figure 4:
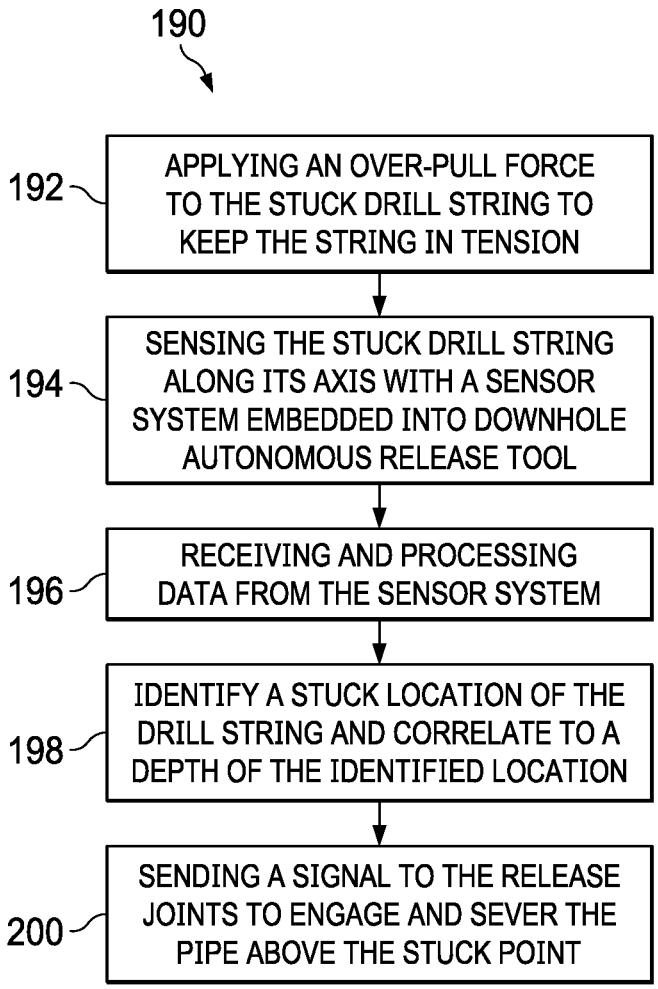
FIG. 4 is a flowchart showing a method for releasing a stuck drill string 106 from a wellbore.

FIGS. 3A and 3B are schematic views illustrating operation of a release tool to release the free portion of a stuck pipe from a wellbore. FIG. 4 illustrates a method 190 for releasing the stuck pipe from the wellbore.

Sometimes during drilling, the drill string 106 gets stuck, for example, due to an accumulation of cuttings, due to differential pressure between the drill string 106 and the wellbore, or due to the geometry of the wellbore 104. When a drill string 106 gets stuck, the drilling crew is unable to move the drill string 106 down to continue drilling, nor can they pull the string out-of-hole without additional tools. The release system 100 with the downhole autonomous release tools 110 simplifies the process by identifying the free point of a stuck drill string 106 and severing the free part out of the hole.

FIG. 3A shows a drilling operation in which contact between a wall of the wellbore 105 and the drill string 106 has caused a stuck point 174. Because the drilling crew is unable to move the drill string 106 down to continue drilling, drilling operations stop. If remedial actions (e.g., application of a pre-determined over-pull or string torque, spotting of freeing pills such as acids, glycol, or others are unsuccessful), the decision may be made cut the string and retrieve the free portion of the string. In some implementations, the release system is activated to identify the stuck point location following several steps. For example, at step 1, the system is activated to identify potential stuck point. At step 2, the user assesses if freeing pills can be pumped to the depth of the stuck point or if working the string free is possible (i.e. application of over-pull and string torque). At step 3, in a loss circulation scenario, it may not be possible to displace freeing pills to the stuck point; or in a wellbore collapse or accumulated cuttings bed scenario severing of the string may be the only option as retrieving the "whole" string to the surface is not possible. At step 4, release the string via the system. Each downhole release tool 110 is activated, for example, by pumping radio frequency identification tags downhole or by serial communication along the line of the tools. The system identifies the stuck point above which the string is free to move and engages the release joint 166 of the adjacent release tool uphole of the stuck point to sever the string at a depth above the stuck point without being independently supported from the surface (e.g., on a wire-line). The release joints can be mechanically or hydraulically actuated.

When ready to use to the release system 100 to locate the stuck point 174, the sensor modules are activated to take a rest state reading of the parameters being used to check whether a specific release tool is above or below the stuck point. If the drilling fluid can still be circulated to the surface, RFID tags with an activation signal can be added to the drilling fluid and pumped downhole. The sensor module 164 of each release tool 110 is activated as the "activation signal" RFID tag 114 passes. In some implementations, the sensor modules include a periodic listening of a "pre-pull" reading.

If the drilling string or wellbore are plugged (i.e., drilling fluid cannot circulate to the surface), the activation signal can be transmitted downhole by a pressure pulse generated by the PSG sub 124 via the fluid column in the drill string 106 or by serial communication along the chain of release tools 110. If the well is in total or partial loss, the drill string 106 can be filled up with a hose to confirm the fluid level in the string. The PSG sub 124 can generate a series of characteristic pressure pulses with a distinctive signature. The PSG sub 124 can be positioned on top of the drill string 106 at the rotary that includes elastomer seal (e.g., "1502" connection type). The PSG sub 124 can create a pressure pulse of a certain strength calibrated to respective locations of each release tool 110.

In the system 100, the sensor module 164 of each release tool 110 measures strain and magnetic field at the individual release tool 110 on activation. Some systems only measure strain or magnetic field.

The collected data is transferred to pre-programmed RFID tags 114 pumped downhole with the drilling fluid as they pass the release tools 110. The RFID tags 114 are equipped with an electronic circuit, programed information, and are pre-paired with the RFID readers. As they flow downhole, the RFID tags 114 approach each RFID reader. The radio frequency (RF) field generated by the reader powers up the RFID tag causing it to continuously transmit its data by 'pulsing' the radio frequency. The data is received by the reader, processed, and the strain and/or magnetic field information is passed back to the RFID tag 114. The RFID tag 114 is collected at surface, and the data processed. If the drilling string or wellbore are plugged (i.e., drilling fluid cannot circulate to the surface), the data can be passed uphole, for example, by serial communication along the chain of release tools 110.

After the sensor modules 164 are activated and the pre-pull data gathered, the over-pull force is applied to the drill string 106. As previously discussed, the over-pull force keeps the string 106 in tension during the identification of the stuck point. The over-pull force is applied without exceeding the yield point limits of the weakest section of the drill string 106.

In the system 100, the sensor modules 164 remain on for a set period of time long enough to apply the over-pull force. In some systems, the sensor modules 164 switch off after data transmission (e.g., after the pre-pull data is transferred). In these systems, a second activation signal is sent downhole to trigger the sensor modules 164 to gather the post-pull data. The post-pull data can be communicated uphole by RFID tags 114 or by serial communication along the chain of release tools 110.

The pre- and post-pull data are compared to identify whether an individual release tool 110 is uphole or downhole of the stuck point 174. Release tools 110 whose pre- and post-pull data are the same are downhole of the stuck point 174. Release tools 110 whose post-pull data indicates an increase in strain and/or a decrease in the magnetic field are under tension and uphole of the stuck point 174.

In the example scenario illustrated by FIG. 3A, the release tool 1101 and the release tool 1102 are under tension which indicates that they are uphole of the stuck point 174. The release tool 1103 is not under tension which indicates that it is downhole of the stuck point 174.

The first release tool 110 uphole of the stuck point 174 is identified as the free point. A strain and magnetic field log can be developed from the captured data, and interpreted to identify the free point 142 (or the stuck point) location of the drill string 106. The identified free point 142 location is correlated with a downhole depth based on a known location of each release tool 110 along the drill string 106. The combination of measuring the strain and the magnetic field accurately identify the "free point" 142 (i.e. the point above which the string is free).

The free point release tool 110 is activated to separate so that the portion of the drill string 106 uphole of the free point can be tripped out of the wellbore 105. In the system 100, the data is processed at control system 176 at the surface and a signal activating the drive system 170 of the free point release tool 110 is transmitted downhole. For example, another RFID tag 110 that is paired with the free point release tool 110 can be pumped downhole. When the RFID reaches the specified release tool 110, the drive system 170 of that tool is activated, the safety pins 168 are sheared, and the release joint 166 rotates about to release the threaded connection with the body 162. The drill string 106 is in tension while the release joint 166 unscrews in the opposite direction (i.e., counter clockwise).

The PSG sub 124 or serial communication along the chain of release tools 110 can also be used to transmit the signal activating the drive system 170 of the free point release tool 110 to the free point release tool 110.

In some systems, the control systems of the individual release tools 110 process the pre- and post-pull data to identify the free point release tool 110. For an individual release tool 110, the control system of that individual release tool 110 checks if that individual release tool 110 is under tension and communicates that status to the adjacent release tools 110. If the individual release tool 110 is under tension, the control system checks the status of the adjacent release tool 110 that is downhole of the individual release tool 110. If the adjacent downhole release tool 110 is also under tension, the individual release tool 110 is not the free point release tool 110. If the adjacent downhole release tool 110 is in its rest state (i.e., not under tension), the individual release tool 110 is the free point release tool 110 and the control system activates the drive system of the individual release tool 110 to separate the release joint 166 of the individual release tool 110.

In the example scenario illustrated by FIG. 3A, the release tool 1102 is identified as the free point release tool 110 and its drive system 170 is activated to separate the release joint 166 of the release tool 1102. After separation, the portion of the drill string uphole of the release tool 1102 is tripped out of the wellbore 105. As illustrated in FIG. 3B, this leaves the release joint of release tool 1102 and the farther downhole portions of the drill string in the wellbore 105.

FIG. 4 is a flowchart showing a method 190 for releasing a stuck drill string 106 from a wellbore. During drilling operations, a drill string 106 is stuck within the wellbore at an unknown depth in open hole. To identify the stuck point location an over-pull force is applied to the stuck drill string 106 to place the string under tension (192). The string is in tension without exceeding the yield point limits of the weakest section of the drill string 106. The downhole autonomous release tool senses the stuck drill string 106 along its axis with a sensor system embedded into tool (194). The sensor system includes RFID readers with piezo-electric crystal-based sensors. The RFID readers detect the change in sensor output by sensing the change in strain or magnetic field or both along the axis of the drill string 106. The real-time data from the sensor system is transmitted to a unit that includes RFID tag or pressure signal generator for processing (196). The data is collected at the surface and a field log can be developed from the captured data to identify the free point (or the stuck point) location (198). The collected data also allows to correlate the free point location with an actual depth of the free point (or stuck point) because the location of each sub in the drill assembly is known. Once the identification is completed, the drill string 106 is sever above the stuck point and retrieved to the surface (200).

Figure 5:
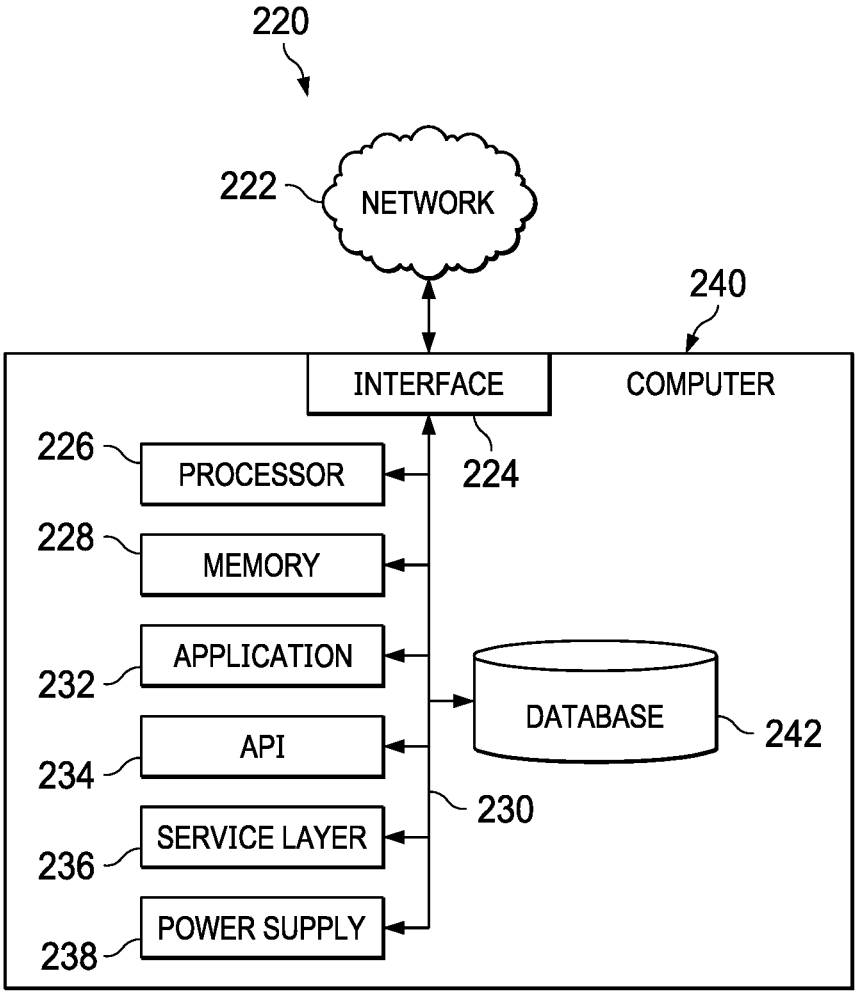
FIG. 5 is a block diagram of an example computer system.

FIG. 5 is a block diagram of an example computer system 244 used to provide computational functionalities associated with described algorithms, methods, functions, processes, flows, and procedures described in the present disclosure, according to some implementations of the present disclosure. The illustrated computer 240 is intended to encompass any computing device such as a server, a desktop computer, a laptop/notebook computer, a wireless data port, a smartphone, a personal data assistant (PDA), a tablet computing device, or one or more processors within these devices, including physical instances, virtual instances, or both. The computer 240 can include input devices such as keypads, keyboards, and touch screens that can accept user information. Also, the computer 240 can include output devices that can convey information associated with the operation of the computer 240. The information can include digital data, visual data, audio information, or a combination of information. The information can be presented in a graphical user interface (UI) (or GUI).

The computer 240 can serve in a role as a client, a network component, a server, a database, a persistency, or components of a computer system for performing the subject matter described in the present disclosure. The illustrated computer 240 is communicably coupled with a network 222. In some implementations, one or more components of the computer 240 can be configured to operate within different environments, including cloud-computing-based environments, local environments, global environments, and combinations of environments.

At a high level, the computer 240 is an electronic computing device operable to receive, transmit, process, store, and manage data and information associated with the described subject matter. According to some implementations, the computer 240 can also include, or be communicably coupled with, an application server, an email server, a web server, a caching server, a streaming data server, or a combination of servers.

The computer 240 can receive requests over network 222 from a client application (for example, executing on another computer 240). The computer 240 can respond to the received requests by processing the received requests using software applications. Requests can also be sent to the computer 240 from internal users (for example, from a command console), external (or third) parties, automated applications, entities, individuals, systems, and computers. Each of the components of the computer 240 can communicate using a system bus 230. In some implementations, any or all of the components of the computer 240, including hardware or software components, can interface with each other or the interface 224 (or a combination of both), over the system bus 230. Interfaces can use an application programming interface (API) 234, a service layer 236, or a combination of the API 234 and service layer 236. The API 234 can include specifications for routines, data structures, and object classes. The API 234 can be either computer-language independent or dependent. The API 234 can refer to a complete interface, a single function, or a set of APIs.

The service layer 236 can provide software services to the computer 240 and other components (whether illustrated or not) that are communicably coupled to the computer 240. The functionality of the computer 240 can be accessible for all service consumers using this service layer. Software services, such as those provided by the service layer 236, can provide reusable, defined functionalities through a defined interface. For example, the interface can be software written in JAVA, C++, or a language providing data in extensible markup language (XML) format. While illustrated as an integrated component of the computer 240, in alternative implementations, the API 234 or the service layer 236 can be stand-alone components in relation to other components of the computer 240 and other components communicably coupled to the computer 240. Moreover, any or all parts of the API 234 or the service layer 236 can be implemented as child or sub-modules of another software module, enterprise application, or hardware module without departing from the scope of the present disclosure.

The computer 240 includes an interface 224. Although illustrated as a single interface 224 in FIG. 10, two or more interfaces 224 can be used according to particular needs, desires, or particular implementations of the computer 240 and the described functionality. The interface 224 can be used by the computer 240 for communicating with other systems that are connected to the network 222 (whether illustrated or not) in a distributed environment. Generally, the interface 224 can include, or be implemented using, logic encoded in software or hardware (or a combination of software and hardware) operable to communicate with the network 222. More specifically, the interface 224 can include software supporting one or more communication protocols associated with communications. As such, the network 222 or the interface's hardware can be operable to communicate physical signals within and outside of the illustrated computer 240.

The computer 240 includes a processor 226. Although illustrated as a single processor 226 in FIG. 10, two or more processors 226 can be used according to particular needs, desires, or particular implementations of the computer 240 and the described functionality. Generally, the processor 226 can execute instructions and can manipulate data to perform the operations of the computer 240, including operations using algorithms, methods, functions, processes, flows, and procedures as described in the present disclosure.

The computer 240 also includes a database 242 that can hold data for the computer 240 and other components connected to the network 222 (whether illustrated or not). For example, database 242 can be an in-memory, conventional, or a database storing data consistent with the present disclosure. In some implementations, database 242 can be a combination of two or more different database types (for example, hybrid in-memory and conventional databases) according to particular needs, desires, or particular implementations of the computer 240 and the described functionality. Although illustrated as a single database 242 in FIG. 10, two or more databases (of the same, different, or combination of types) can be used according to particular needs, desires, or particular implementations of the computer 240 and the described functionality. While database 242 is illustrated as an internal component of the computer 240, in alternative implementations, database 242 can be external to the computer 240.

The computer 240 also includes a memory 228 that can hold data for the computer 240 or a combination of components connected to the network 222 (whether illustrated or not). Memory 228 can store any data consistent with the present disclosure. In some implementations, memory 228 can be a combination of two or more different types of memory (for example, a combination of semiconductor and magnetic storage) according to particular needs, desires, or particular implementations of the computer 240 and the described functionality. Although illustrated as a single memory 228 in FIG. 10, two or more memories 228 (of the same, different, or combination of types) can be used according to particular needs, desires, or particular implementations of the computer 240 and the described functionality. While memory 228 is illustrated as an internal component of the computer 240, in alternative implementations, memory 228 can be external to the computer 240.

The application 232 can be an algorithmic software engine providing functionality according to particular needs, desires, or particular implementations of the computer 240 and the described functionality. For example, application 232 can serve as one or more components, modules, or applications. Further, although illustrated as a single application 232, the application 232 can be implemented as multiple applications 232 on the computer 240. In addition, although illustrated as internal to the computer 240, in alternative implementations, the application 232 can be external to the computer 240.

The computer 240 can also include a power supply 238. The power supply 238 can include a rechargeable or non-rechargeable battery that can be configured to be either user- or non-user-replaceable. In some implementations, the power supply 238 can include power-conversion and management circuits, including recharging, standby, and power management functionalities. In some implementations, the power-supply 238 can include a power plug to allow the computer 240 to be plugged into a wall socket or a power source to, for example, power the computer 240 or recharge a rechargeable battery.

There can be any number of computers 240 associated with, or external to, a computer system containing computer 240, with each computer 240 communicating over network 222. Further, the terms "client," "user," and other appropriate terminology can be used interchangeably, as appropriate, without departing from the scope of the present disclosure. Moreover, the present disclosure contemplates that many users can use one computer 240 and one user can use multiple computers 240.

Implementations of the subject matter and the functional operations described in this specification can be implemented in digital electronic circuitry, intangibly embodied computer software or firmware, in computer hardware, including the structures disclosed in this specification and their structural equivalents, or in combinations of one or more of them. Software implementations of the described subject matter can be implemented as one or more computer programs. Each computer program can include one or more modules of computer program instructions encoded on a tangible, non-transitory, computer-readable computer-storage medium for execution by, or to control the operation of, data processing apparatus. Alternatively, or additionally, the program instructions can be encoded in/on an artificially-generated propagated signal. The example, the signal can be a machine-generated electrical, optical, or electromagnetic signal that is generated to encode information for transmission to suitable receiver apparatus for execution by a data processing apparatus. The computer-storage medium can be a machine-readable storage device, a machine-readable storage substrate, a random or serial access memory device, or a combination of computer-storage mediums.

The terms "data processing apparatus," "computer," and "electronic computer device" (or equivalent as understood by one of ordinary skill in the art) refer to data processing hardware. For example, a data processing apparatus can encompass all kinds of apparatus, devices, and machines for processing data, including by way of example, a programmable processor, a computer, or multiple processors or computers. The apparatus can also include special purpose logic circuitry including, for example, a central processing unit (CPU), a field programmable gate array (FPGA), or an application specific integrated circuit (ASIC). In some implementations, the data processing apparatus or special purpose logic circuitry (or a combination of the data processing apparatus or special purpose logic circuitry) can be hardware- or software-based (or a combination of both hardware- and software-based). The apparatus can optionally include code that creates an execution environment for computer programs, for example, code that constitutes processor firmware, a protocol stack, a database management system, an operating system, or a combination of execution environments. The present disclosure contemplates the use of data processing apparatuses with or without conventional operating systems, for example LINUX, UNIX, WINDOWS, MAC OS, ANDROID, or IOS.

A computer program, which can also be referred to or described as a program, software, a software application, a module, a software module, a script, or code, can be written in any form of programming language. Programming languages can include, for example, compiled languages, interpreted languages, declarative languages, or procedural languages. Programs can be deployed in any form, including as stand-alone programs, modules, components, subroutines, or units for use in a computing environment. A computer program can, but need not, correspond to a file in a file system. A program can be stored in a portion of a file that holds other programs or data, for example, one or more scripts stored in a markup language document, in a single file dedicated to the program in question, or in multiple coordinated files storing one or more modules, sub programs, or portions of code. A computer program can be deployed for execution on one computer or on multiple computers that are located, for example, at one site or distributed across multiple sites that are interconnected by a communication network. While portions of the programs illustrated in the various figures may be shown as individual modules that implement the various features and functionality through various objects, methods, or processes, the programs can instead include a number of sub-modules, third-party services, components, and libraries. Conversely, the features and functionality of various components can be combined into single components as appropriate. Thresholds used to make computational determinations can be statically, dynamically, or both statically and dynamically determined.

The methods, processes, or logic flows described in this specification can be performed by one or more programmable computers executing one or more computer programs to perform functions by operating on input data and generating output. The methods, processes, or logic flows can also be performed by, and apparatus can also be implemented as, special purpose logic circuitry, for example, a CPU, an FPGA, or an ASIC.

Computers suitable for the execution of a computer program can be based on one or more of general and special purpose microprocessors and other kinds of CPUs. The elements of a computer are a CPU for performing or executing instructions and one or more memory devices for storing instructions and data. Generally, a CPU can receive instructions and data from (and write data to) a memory. A computer can also include, or be operatively coupled to, one or more mass storage devices for storing data. In some implementations, a computer can receive data from, and transfer data to, the mass storage devices including, for example, magnetic, magneto optical disks, or optical disks. Moreover, a computer can be embedded in another device, for example, a mobile telephone, a personal digital assistant (PDA), a mobile audio or video player, a game console, a global positioning system (GPS) receiver, or a portable storage device such as a universal serial bus (USB) flash drive.

Computer readable media (transitory or non-transitory, as appropriate) suitable for storing computer program instructions and data can include all forms of permanent/non-permanent and volatile/non-volatile memory, media, and memory devices. Computer readable media can include, for example, semiconductor memory devices such as random access memory (RAM), read only memory (ROM), phase change memory (PRAM), static random access memory (SRAM), dynamic random access memory (DRAM), erasable programmable read-only memory (EPROM), electrically erasable programmable read-only memory (EEPROM), and flash memory devices. Computer readable media can also include, for example, magnetic devices such as tape, cartridges, cassettes, and internal/removable disks. Computer readable media can also include magneto optical disks and optical memory devices and technologies including, for example, digital video disc (DVD), CD ROM, DVD+/−R, DVD-RAM, DVD-ROM, HD-DVD, and BLU-RAY. The memory can store various objects or data, including caches, classes, frameworks, applications, modules, backup data, jobs, web pages, web page templates, data structures, database tables, repositories, and dynamic information. Types of objects and data stored in memory can include parameters, variables, algorithms, instructions, rules, constraints, and references. Additionally, the memory can include logs, policies, security or access data, and reporting files. The processor and the memory can be supplemented by, or incorporated in, special purpose logic circuitry.

Implementations of the subject matter described in the present disclosure can be implemented on a computer having a display device for providing interaction with a user, including displaying information to (and receiving input from) the user. Types of display devices can include, for example, a cathode ray tube (CRT), a liquid crystal display (LCD), a light-emitting diode (LED), and a plasma monitor. Display devices can include a keyboard and pointing devices including, for example, a mouse, a trackball, or a trackpad. User input can also be provided to the computer through the use of a touchscreen, such as a tablet computer surface with pressure sensitivity or a multi-touch screen using capacitive or electric sensing. Other kinds of devices can be used to provide for interaction with a user, including to receive user feedback, for example, sensory feedback including visual feedback, auditory feedback, or tactile feedback. Input from the user can be received in the form of acoustic, speech, or tactile input. In addition, a computer can interact with a user by sending documents to, and receiving documents from, a device that is used by the user. For example, the computer can send web pages to a web browser on a user's client device in response to requests received from the web browser.

The term "graphical user interface," or "GUI," can be used in the singular or the plural to describe one or more graphical user interfaces and each of the displays of a particular graphical user interface. Therefore, a GUI can represent any graphical user interface, including, but not limited to, a web browser, a touch screen, or a command line interface (CLI) that processes information and efficiently presents the information results to the user. In general, a GUI can include a plurality of user interface (UI) elements, some or all associated with a web browser, such as interactive fields, pull-down lists, and buttons. These and other UI elements can be related to or represent the functions of the web browser.

Implementations of the subject matter described in this specification can be implemented in a computing system that includes a back end component, for example, as a data server, or that includes a middleware component, for example, an application server. Moreover, the computing system can include a front-end component, for example, a client computer having one or both of a graphical user interface or a Web browser through which a user can interact with the computer. The components of the system can be interconnected by any form or medium of wireline or wireless digital data communication (or a combination of data communication) in a communication network. Examples of communication networks include a local area network (LAN), a radio access network (RAN), a metropolitan area network (MAN), a wide area network (WAN), Worldwide Interoperability for Microwave Access (WIMAX), a wireless local area network (WLAN) (for example, using 802.11 a/b/g/n or 802.20 or a combination of protocols), all or a portion of the Internet, or any other communication system or systems at one or more locations (or a combination of communication networks). The network can communicate with, for example, Internet Protocol (IP) packets, frame relay frames, asynchronous transfer mode (ATM) cells, voice, video, data, or a combination of communication types between network addresses.

The computing system can include clients and servers. A client and server can generally be remote from each other and can typically interact through a communication network. The relationship of client and server can arise by virtue of computer programs running on the respective computers and having a client-server relationship.

Cluster file systems can be any file system type accessible from multiple servers for read and update. Locking or consistency tracking may not be necessary since the locking of exchange file system can be done at application layer. Furthermore, Unicode data files can be different from non-Unicode data files.

While this specification contains many specific implementation details, these should not be construed as limitations on the scope of what may be claimed, but rather as descriptions of features that may be specific to particular implementations. Certain features that are described in this specification in the context of separate implementations can also be implemented, in combination, in a single implementation. Conversely, various features that are described in the context of a single implementation can also be implemented in multiple implementations, separately, or in any suitable sub-combination. Moreover, although previously described features may be described as acting in certain combinations and even initially claimed as such, one or more features from a claimed combination can, in some cases, be excised from the combination, and the claimed combination may be directed to a sub-combination or variation of a sub-combination.

Particular implementations of the subject matter have been described. Other implementations, alterations, and permutations of the described implementations are within the scope of the following claims as will be apparent to those skilled in the art. While operations are depicted in the drawings or claims in a particular order, this should not be understood as requiring that such operations be performed in the particular order shown or in sequential order, or that all illustrated operations be performed (some operations may be considered optional), to achieve desirable results. In certain circumstances, multitasking or parallel processing (or a combination of multitasking and parallel processing) may be advantageous and performed as deemed appropriate.

Moreover, the separation or integration of various system modules and components in the previously described implementations should not be understood as requiring such separation or integration in all implementations, and it should be understood that the described program components and systems can generally be integrated together in a single software product or packaged into multiple software products.

Accordingly, the previously described example implementations do not define or constrain the present disclosure. Other changes, substitutions, and alterations are also possible without departing from the spirit and scope of the present disclosure.

Furthermore, any claimed implementation is considered to be applicable to at least a computer-implemented method; a non-transitory, computer-readable medium storing computer-readable instructions to perform the computer-implemented method; and a computer system comprising a computer memory interoperably coupled with a hardware processor configured to perform the computer-implemented method or the instructions stored on the non-transitory, computer-readable medium.

A number of embodiments of these systems and methods have been described. Nevertheless, it will be understood that various modifications may be made without departing from the spirit and scope of this disclosure. Accordingly, other embodiments are within the scope of the following claims.

What is claimed:

1. A downhole release tool configured to release a string in a wellbore, the downhole release tool comprising:

a cylindrical body with an uphole end defining a first set of internal threads and a downhole end defining a second set of internal threads;

a sensor module disposed on an outer surface of the cylindrical body, the sensor module operable to measure strain in the cylindrical body, a magnetic field, or both, the sensor module comprising an acoustic sensor;

a release joint with an uphole end defining a first set of external threads and a frustoconical downhole end defining a second set of external threads, the release joint attached to the cylindrical body by engagement between the first set of external threads of the release joint and the second set of internal threads of the cylindrical body;

safety pins rotationally fixing the release joint in position relative to the cylindrical body; and a hollow drive system operable to rotate the release joint relative to the cylindrical body.

2. The downhole release tool of claim 1, wherein the sensor module comprises one or more radio frequency identification (RFID) readers.

3. The downhole release tool of claim 2, wherein the sensor module comprises a piezo-electric crystal sensor.

4. The downhole release tool of claim 2, wherein the sensor module is positioned in a recess on an outer surface of the cylindrical body.

5. The downhole release tool of claim 1, wherein the sensor module further comprises a feedback mechanism.

6. The downhole release tool of claim 1, wherein the cylindrical body has an internal diameter equal to an internal diameter of a pipe in the string.

7. The downhole release tool of claim 1, wherein the hollow drive system comprises a turbine.

8. The downhole release tool of claim 1, further comprising a locking mechanism.

9. A system for releasing a drill string in a wellbore, the system comprising:

a plurality of downhole autonomous release tools, wherein each of the plurality of downhole autonomous release tools comprises:

a cylindrical body;

a sensor module disposed on an outer surface of the cylindrical body, the sensor module operable to measure strain in the cylindrical body, a magnetic field, or both, the sensor module comprising an acoustic sensor;

a release joint attached to the cylindrical body by a threaded connection;

safety pins rotationally fixing the release joint in position relative to the cylindrical body;

a hollow drive system operable to rotate the release joint relative to the cylindrical body; and a plurality of radio frequency identification (RFID) tags in communication with the sensor module and configured to be pump downhole.

10. The system for releasing a drill string of claim 9, wherein a first downhole autonomous release tool is spaced between 100 and 200 feet from an adjacent second, downhole autonomous release tool.

11. The system for releasing a drill string of claim 9, wherein a first downhole autonomous release tool is spaced between 200 and 500 feet from an adjacent second, downhole autonomous release tool.

12. The system for releasing a drill string of claim 9, wherein the sensor module comprises one or more radio frequency identification (RFID) readers.

13. The system for releasing a drill string of claim 12, wherein the sensor module comprises a piezo-electric crystal sensor.

14. The system for releasing a drill string of claim 9, wherein the hollow drive system comprises a turbine.

15. A method for releasing a drill string in a wellbore, the method comprising:

applying an over-pull force to a stuck drill string to keep the drill string in tension;

sensing the stuck drill string along its axis with a sensor system comprising an acoustic sensor embedded into a downhole autonomous release tool;

receiving and processing data from the sensor system;

identifying a stuck location of the drill string and correlating the stuck location to a depth of the stuck location; and sending a signal to a hollow drive system of the downhole autonomous release tool to engage and sever the drill string above the stuck location.

* * * * *